United States Patent [19]

Letsche et al.

[11] Patent Number: 4,711,220

[45] Date of Patent: Dec. 8, 1987

[54] PRESSURE OIL GUIDE DEVICE FOR INJECTION PUMP SHAFT

[75] Inventors: Ulrich Letsche, Stuttgart, Fed. Rep. of Germany; Wolfgang Rapp, deceased, late of Esslingen, Fed. Rep. of Germany, by Gilsea Rapp, heir; Guenther Haefner, Berglen; Wilhelm Tonhaeuser, Korb, both of Fed. Rep. of Germany

[73] Assignee: Daimler-Benz Aktiengesellschaft, Stuttgart, Fed. Rep. of Germany

[21] Appl. No.: 794,539

[22] Filed: Nov. 4, 1985

[30] Foreign Application Priority Data

Nov. 2, 1984 [DE] Fed. Rep. of Germany ..... 3440053
Jun. 8, 1985 [DE] Fed. Rep. of Germany ..... 3520667

[51] Int. Cl.[4] ..... F02M 59/20
[52] U.S. Cl. ..... 123/502
[58] Field of Search ..... 123/450, 501, 502; 417/462

[56] References Cited

U.S. PATENT DOCUMENTS

| | | | |
|---|---|---|---|
| 2,833,263 | 5/1958 | Evans | 123/450 |
| 2,916,029 | 12/1959 | Kemp | 123/502 |
| 3,401,572 | 9/1968 | Bailey | 123/501 |
| 3,433,159 | 3/1969 | Kemp | 123/502 X |
| 3,943,902 | 3/1976 | Skinner | 123/502 X |

FOREIGN PATENT DOCUMENTS 1258181 1/1968 Fed. Rep. of Germany .

*Primary Examiner*—Tony M. Argenbright
*Attorney, Agent, or Firm*—Barnes & Thornburg

[57] ABSTRACT

This invention relates to a hydraulic-oil feeding device for a hydraulically operated injection timing mechanism disposed on the injection pump shaft of an injection pump for air-compressing injection-type internal-combustion engines. A pump shaft is partially disposed in an injection pump housing. A feeding member leads from the pump housing to the pump shaft. An arrangement of bores forms a passage or transition between the feeding member and the injection timing mechanism. The passage is interrupted during each injection process, and the passage is open in between injection processes.

17 Claims, 10 Drawing Figures

Fig.3
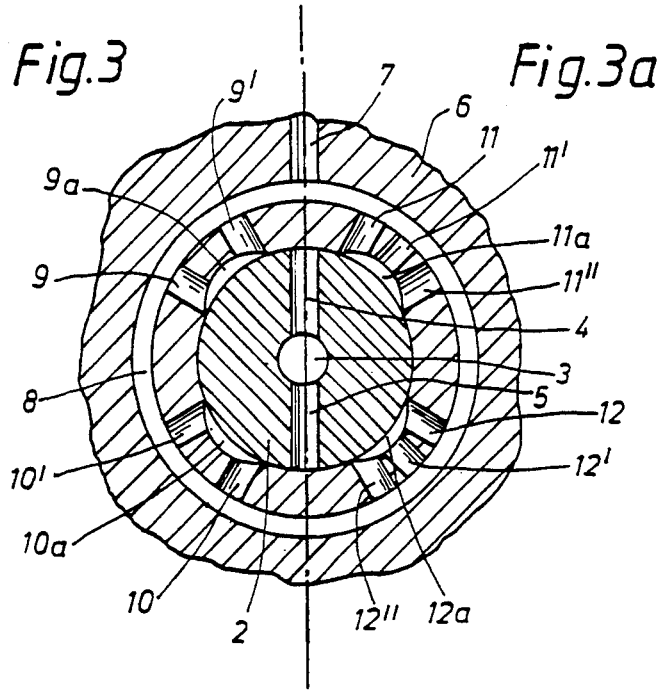
Fig.3a
Fig.4
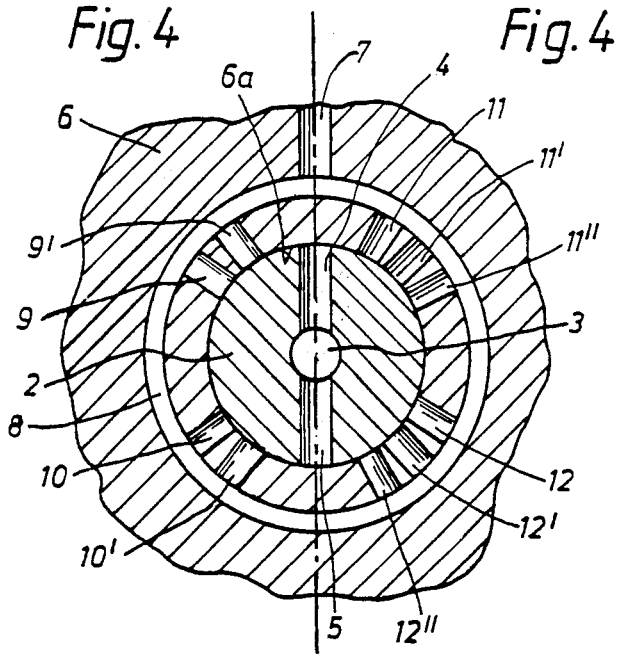
Fig.4a

PRESSURE OIL GUIDE DEVICE FOR INJECTION PUMP SHAFT

BACKGROUND AND SUMMARY OF THE INVENTION

This invention relates to a hydraulic-oil feeding device for a hydraulically operated injection timing mechanism disposed on the injection pump shaft of an injection pump. This arrangement controls the injection start for multicylinder air-compressing injection-type internal combustion engines.

In conventional hydraulically operated injection timing mechanisms, the effective working surface of an adjusting element is arranged in the injection timing mechanism rotating at pump speed. In this case, the feeding of the hydraulic medium takes place according to U.S. Pat. No. 3,401,572 via a duct and a ring groove on the housing and cross bores and longitudinal bores in the injection pump shaft.

It is known that the drive torque of the injection pump takes an extremely irregular course. The required peak torque during the actual injection phases is several times that of the mean drive torque. The injection timing mechanism must transfer these peak torques completely. Therefore, in the case of hydraulically operated injection timing mechanisms, i.e., those with electric control, the effective working surfaces and operating pressures must be designed for the torque peaks.

An object of the invention is to provide a structurally simple hydraulic-oil feeding device without additional control elements by means of which the transfer of the torque peaks, with respect to function, can be separated from the actual adjusting.

These objects are achieved by providing a hydraulic oil feeding device which has a pump shaft partially disposed in an injection pump housing. A pump feeding member is also provided in the pump housing. A passage forming means is provided between the pump feeding member and the pump shaft.

During each injection process the connection at the transition from the hydraulic-oil feeding member in the injection pump housing to the passage arrangement in the injection pump shaft is interrupted over a certain angle-of-rotation area. Therefore, no hydraulic medium can flow in or out at the injection timing mechanism during the injection process. The passage is open in between injection processes. The two functions of the injection timing mechanism, namely the transfer of the pump drive torques and the adjusting function, are therefore disconnected. In the case of injection timing mechanisms of this type, the effective surfaces and the operating pressures must therefore no longer be designed for the high torque peaks.

The design according to the invention does not require any additional components for the disconnecting. The only measure that is required is a different manufacturing process at the injection pump shaft or at the injection pump housing. The disconnecting can therefore take place independently in a speed-synchronized and phase-synchronized manner without any control from the outside.

Further objects, features, and advantages of the present invention will become more apparent from the following description when taken with the accompanying drawings which show, for purposes of illustration only, several embodiments in accordance with the present invention.

BRIEF DESCRIPTION OF THE DRAWINGS

FIG. 3 is a cross-sectional view of the left half of one embodiment of the oil feeding device;

FIG. 3*a* is a cross-sectional view of the right half of one embodiment of the oil feeding device;

FIG. 4 is a cross-sectional view of the left half of another embodiment of the oil feeding device;

FIG. 4*a* is a cross-sectional view of the right half of another embodiment of the oil feeding device;

DETAILED DESCRIPTION OF THE DRAWINGS

Figure 1:
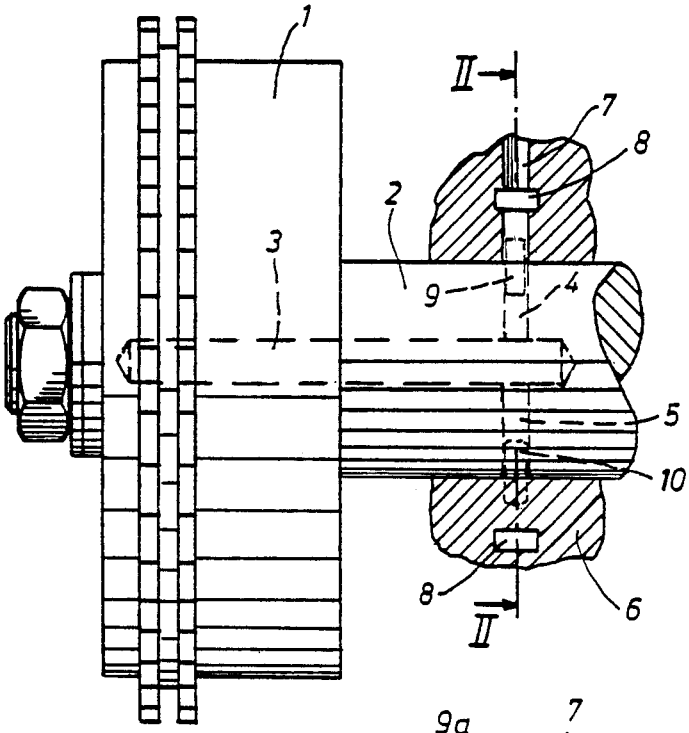
FIG. 1 is a side cross-sectional side view of one embodiment of the oil feeding device.
Figure 2:
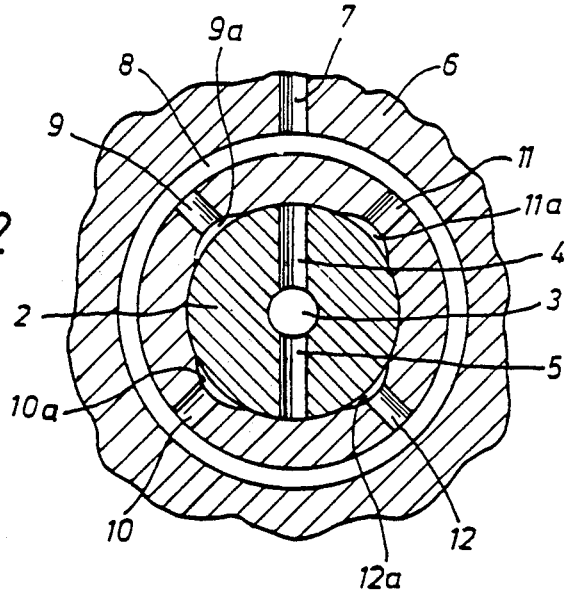
FIG. 2 is the cross-sectional view of one embodiment of the device according to line II—II in FIG. 1.

Shown in FIGS. 1 to 4 is the hydraulic-oil feeding device for the disconnection of the drive torque and the adjusting torque for a hydraulically operated injection timing mechanism 1 on the injection pump shaft 2. This device is used with an injection pump for air-compressing self-igniting internal-combustion engines. The device is equipped with an arrangement of bores in the injection pump shaft 2, composed of a centrally extending axial bore 3 leading to the injection timing mechanism 1, and at least one radial bore 4 originating from the circumference of the shaft and leading into the axial bore 3. In FIG. 2, two radial bores 4 and 5 are provided which are arranged diametrially with respect to one another and are used for expanding the cross-section for the flow of oil to the injection mechanism 1.

The radial bores 4 and 5 are at times connected with a hydraulic-oil feeding device arranged in the injection pump housing 6. This hydraulic-oil feeding device includes a single feeding bore 7, an oil ring space 8 and radial housing bores 9, 10, 11, 12. The number of radial bores corresponds with the number of cylinders of the internal-combustion engine and are evenly distributed at the circumference of the pump shaft. The bores are evenly distributed to provide equal cycles of the open passage position and the interrupted passge position. As shown in FIG. 2, cross-sectional recesses 9*a*, 10*a*, 11*a*, 12*a* are formed as pockets in the pump housing, and each recess surrounds a corresponding radial housing bore.

The oil flows from the feeding bore 7 into the oil ring space 8, into the radial housing bores 9, 10, 11, 12 and into the cross sectional recesses 9*a*, 10*a*, 11*a*, 12*a* which extend in a circumferential direction. Each recess has a length that is significantly larger than the diameter of each radial bore 9–12.

In the position shown in FIG. 2, the connection or transition from the oil feeding device in the injection pump housing 6 to the injection timing mechanism 1 is interrupted because the radial bores 4, 5 on the pump shaft 2 are disposed between the respective cross-sectional recesses 9*a*, 10*a*, 11*a*, , 12*a*. The interruption takes place during the injection processes. The interruption is eliminated between the injection processes as soon as the radial bores 4, 5 are opposite the respective cross-sectional recesses 9*a*, 10*a*, 11*a*, 12*a*. The feeding of oil to the axial bore 3 therefore takes place on two sides in between the injection processes.

As shown in FIG. 3, two radial housing bores 9,9'; 10,10' lead into respective cross-sectional recesses 9*a*, 10*a*. (In FIG. 3 only the left half is shown.) As shown in FIG. 3*a*, three radial housing bores 11, 11', 11''; 12, 12', 12'' lead into respective cross-sectional recesses in 11*a*, 12*a*. (In FIG. 3*a* only the right half is shown). As shown in FIGS. 3, 3*a* the radial housing bores are spaced circumferentially around the pump shaft.

In the embodiments according to FIGS. 4 and 4*a* (left and right half), the radial housing bores of each group, forming a single open passage position in between injection processes, are also spaced apart around the circumference of the pump shaft. FIGS. 4 and 4*a* differ from FIGS. 3 and 3*a* in that no cross-sectional recesses are provided in the injection pump housing 6. Embodiments without cross-sectional recesses, in regard to manufacturing and engineering, are easier to produce.

Figure 5:
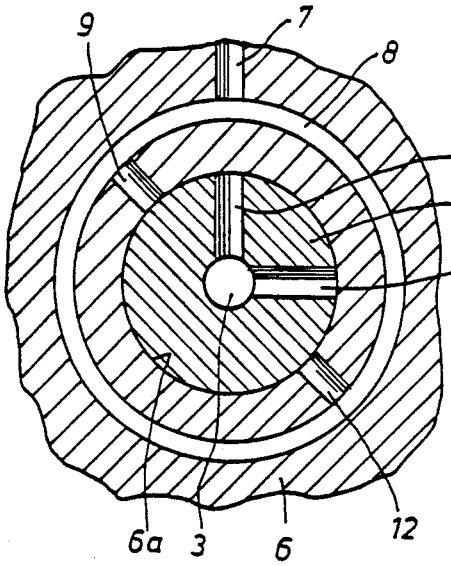
FIG. 5 is a cross-sectional view of another embodiment of the invention.

Another embodiment having no cross-sectional recesses is shown in FIG. 5. This embodiment has bores 4, 5 in the injection pump shaft 2 which are staggered with respect to one another by an angle of 90°. With this arrangement, only half the number of radial housing bores is required. These radial housing bores are diametrically opposite one another. The radial housing bores may be provided individually (9, 12), in pairs or in groups of three. The embodiment shown in FIG. 5 can also be provided with cross-sectional recesses worked into the injection pump housing 6.

Figure 7:
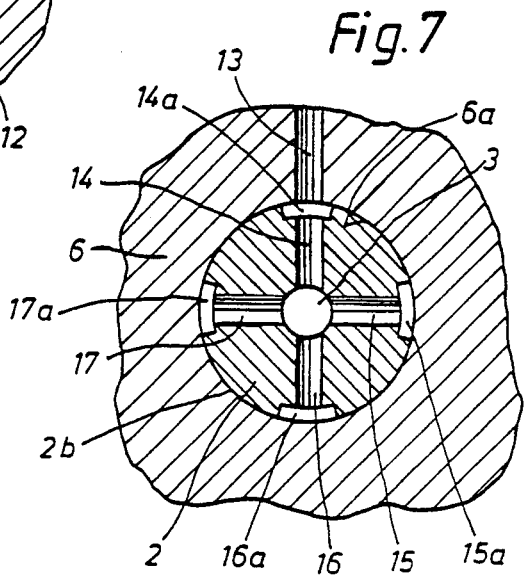
FIG. 7 is a cross-sectional view according to Line VII—VII in FIG. 6.
Figure 6:
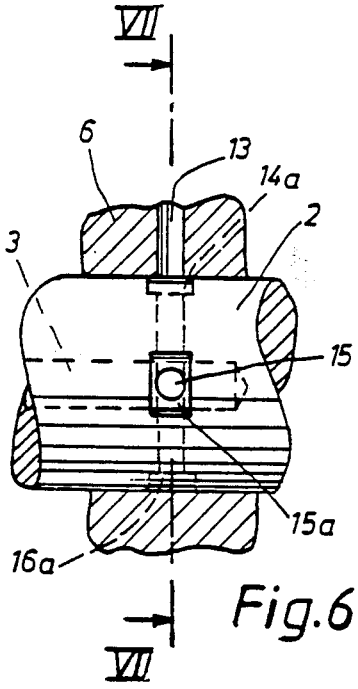
FIG. 6 is a side cross-sectional view of an embodiment of the oil feeding device.

The embodiment according to FIGS. 6 and 7 has an oil feeding hole 13 which leads to the injection pump shaft 2. The injection pump shaft 2 has a centrally extending axial bore 3 and four radial bores 14, 15, 16, 17 leading into the axial bore 3. Cross-sectional recesses 14*a*, 15*a*, 16*a*, 17*a* surround each of these radial bores. The cross-sectional recesses 14*a*, 15*a*, 16*a*, 17*a* are formed by short grooves at the shaft circumference 2*b* extending in circumferential direction and being connectable to the feeding bore 13. The grooves and the radial bores are evenly distributed around the circumference of the injection pump shaft. The number of grooves and respective radial bores correspond to the number of cylinders of the internal-combustion engine.

Instead of circumferential grooves, recesses may also be produced at the shaft circumference by drilling vertically to the shaft axis.

Longitudinal grooves that are similar to a feathered groove are also possible and may be produced by milling with a disk cutter.

Figure 8:
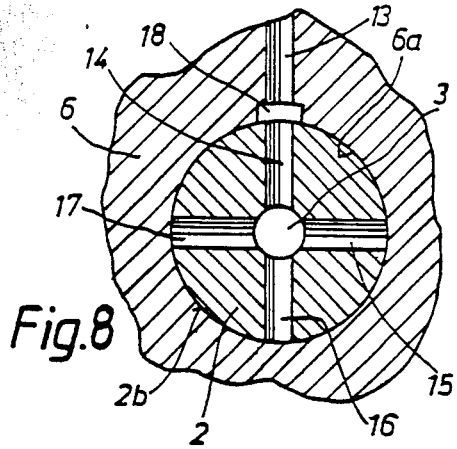
FIG. 8 is a cross-sectional view of another embodiment of the oil feeding device.

In the embodiment according to FIG. 8, the radial bores 14, 15, 16, 17 end directly at the shaft circumference 2*b* and only one cross-sectional recess 18 is located at the bearing surface 6*a* of the injection pump housing 6. The oil feeding bore 13 leads into the cross-sectional recess 18.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A hydraulic oil feeding device comprising:

a pump shaft, a portion of said pump shaft being disposed in an injection pump housing;

a pump feeding means in said injection pump housing;

a passage forming means in said pump shaft for forming a passage between said pump housing feeding means and an injection timing mechanism, said passage forming means including a centrally extending axial bore in said pump shaft and at least one radial bore in said pump shaft connecting said axial bore to said pump housing feeding means, said passage forming means having an interrupted passage position during an injection process and an open passage position in between injection processes.

2. A hydraulic oil feeding device of claim 1, wherein said radial bores are equally spaced around the circumference of the pump shaft.

3. A hydraulic oil feeding device of claim 1, including a cross-sectional recess formed in said pump housing surrounding said feeding member, said recess having a diameter greater than said radial bore.

4. A hydraulic oil feeding device of claim 3, wherein said cross-sectional recess is formed by a circumferential groove extending in circumferential direction, the longitudinal extension of which is larger than the diameter of each radial bore.

5. A hydraulic oil feeding device of claim 3, including a radial bore for each cylinder of an internal combustion engine.

6. A hydraulic oil feeding device of claim 1, including a cross-sectional recess formed in said pump shaft surrounding each of said radial bores, said recess having a diameter greater than said radial bores.

7. A hydraulic oil feeding device of claim 6, wherein each cross-sectional recess is formed by a circumferential groove extending in circumferential direction, the longitudinal extension of which is larger than the diameter of each radial bore.

8. A hydraulic oil feeding device of claim 6, including a radial bore for each cylinder of an internal combustion engine.

9. A hydraulic oil feeding device of claim 1, wherein said passage forming means further comprises an annular space formed in said pump housing encircling said pump shaft, said annular space forming a passage between said pump feeding means and said pump shaft.

10. A hydraulic oil feeding device of claim 9, wherein a portion of said housing is disposed between said annular space and said pump shaft, said housing portion having at least one radial housing bore forming a passage between said annular space and said pump shaft.

11. A hydraulic feeding device of claim 10, wherein only two radial housing bores are disposed diametrically opposite one another, and two radial bores of said pump shaft are disposed at right angles with respect to one another.

12. A hydraulic oil feeding device of claim 10, wherein each of said radial housing bores has a mouth located in a bearing surface of the injection pump housing.

13. A hydraulic oil feeding device of claim 10, including a cross-sectional recess formed in said pump housing adjacent said pump shaft surrounding each radial housing bore, said recess having a diameter greater than said radial bores.

14. A hydraulic oil feeding device of claim 13, wherein each cross-sectional recess is formed by a circumferential groove extending in circumferential direction, the longitudinal extension of which is larger than the diameter of each radial housing bore.

15. A hydraulic oil feeding device of claim 10, wherein a plurality of adjacent housing radial bores form a single open passage position between said annular space and said pump shaft.

16. A hydraulic oil feeding device of claim 15, including a cross-sectional recess formed in said pump housing adjacent said pump shaft surrounding the plurality of adjacent radial housing bores forming a single open passage position, said recess having a diameter than said radial bore.

17. A hydraulic oil feeding device of claim 16, wherein each cross-sectional recess is formed by a circumferential groove extending in circumferential direction, the longitudinal extension of which is larger than the diameter of each radial bore.

* * * * *